US009975231B2

(12) United States Patent
Jones

(10) Patent No.: US 9,975,231 B2
(45) Date of Patent: May 22, 2018

(54) SELF-CONTAINED FORCE MAGNIFYING CHISEL

(71) Applicant: Jared Scott Jones, Salt Lake City, UT (US)

(72) Inventor: Jared Scott Jones, Salt Lake City, UT (US)

( * ) Notice: Subject to any disclaimer, the term of this patent is extended or adjusted under 35 U.S.C. 154(b) by 11 days.

(21) Appl. No.: 14/939,041

(22) Filed: Nov. 12, 2015

(65) Prior Publication Data

US 2016/0158928 A1 Jun. 9, 2016

Related U.S. Application Data

(60) Provisional application No. 62/088,026, filed on Dec. 5, 2014.

(51) Int. Cl.
*B25D 3/00* (2006.01)

(52) U.S. Cl.
CPC ..... *B25D 3/00* (2013.01)

(58) Field of Classification Search
CPC ..... B25D 3/00
USPC ..... 30/167, 167.1, 167.2, 168, 367
See application file for complete search history.

(56) References Cited

U.S. PATENT DOCUMENTS 833,712 A * 10/1906 Geisenhoner ..... B25D 5/00 30/367
1,229,732 A * 6/1917 Erickson ..... B23D 29/005 30/277
1,665,109 A * 4/1928 Nelson ..... B25D 3/00 30/277
2,135,404 A * 11/1938 Lofstrand, Sr. ..... B02C 19/0087 241/99
2,446,848 A * 8/1948 Prester ..... B25D 5/00 30/367
2,485,877 A * 10/1949 Hamilton, Jr. ..... A01G 3/06 111/99
2,675,079 A * 4/1954 Hughes ..... C14B 5/00 30/367
3,036,482 A * 5/1962 Kenworthy ..... B25C 1/02 173/90
4,458,415 A * 7/1984 Maher ..... B25B 27/02 144/195.5
4,829,673 A * 5/1989 Hicks ..... B25D 3/00 30/167

(Continued)

OTHER PUBLICATIONS

SpringTools Website, 5/16" Cold Chisel, Dec. 4, 2014 http://springtools.shptron.com/p/5-16-cold-chisel?pp=24 (2 pages).

*Primary Examiner* — Hwei C Payer
(74) *Attorney, Agent, or Firm* — Travis R. Banta; TechLaw Ventures, PLLC

(57) ABSTRACT

The self-contained force magnifying chisel disclosed herein includes a chisel portion, a striker, at least a portion of which is disposed within the chisel portion, and a spring, a least a portion of which is disposed within the chisel portion. The spring attaches to both the chisel portion and the striker. When the striker is pulled by a user, the spring stores mechanical energy. When the user releases the striker, the striker impacts on the chisel portion transferring the mechanical energy stored in the spring into a driving force. The force is magnified by a chisel blade on the chisel portion of the self-contained force magnifying chisel and applied to a workpiece.

10 Claims, 4 Drawing Sheets

(56) References Cited

U.S. PATENT DOCUMENTS

| | | | | |
|---|---|---|---|---|
| 8,141,255 | B2 * | 3/2012 | Su | B25D 3/00 173/90 |
| 9,592,797 | B2 * | 3/2017 | Jackson | B60S 3/045 |
| 2016/0158928 | A1 * | 6/2016 | Jones | B25D 3/00 30/167 |

* cited by examiner

SELF-CONTAINED FORCE MAGNIFYING CHISEL

PRIORITY CLAIM

This application claims priority to U.S. Provisional Application No. 62/088,026, filed on Dec. 5, 2014, which is herein incorporated by reference in its entirety.

BACKGROUND

1. Technical Field

An apparatus disclosed herein generally relates to hand tools. More specifically, the apparatus disclosed herein relates to handheld chisels.

2. Description of the Related Art

Chisels are hand tools with a sharpened, or bladed, end for cutting, carving, or breaking stone, metal, and wood and a non-sharpened end. Conventional chisels require the use of a mallet or a hammer to strike a non-sharpened end of the chisel in order to drive the chisel into a workpiece. A workpiece may therefore be cut, shaped, carved, broken, or cleaned by positioning the chisel on the work piece and hitting the chisel with a mallet or a hammer.

Conventional chisels have several drawbacks. First, as discussed above, users of conventional chisels hold a conventional chisel in one hand and strike the chisel with a hammer or mallet using another hand. Even skilled users, however, can miss the chisel with the hammer or mallet and land a striking blow on the hand that is holding the chisel, causing injury to the hand holding the chisel. This problem is only exacerbated when the chisel is held by one person and the hammer blows are delivered by a second person. At least one object of at least one apparatus disclosed herein is to provide a chisel that prevents injury to a user of a chisel.

Second, conventional chisels cannot be operated without an additional tool, namely, a hammer or mallet. The mechanical advantage of a chisel is provided in focusing the force of a striking blow into a sharpened end of the chisel. However, that mechanical advantage cannot be obtained without some additional tool to provide a striking blow to the chisel. Thus, at least one problem with conventional chisels is that conventional chisels require the use of two tools for proper operation. It is one object of at least one apparatus disclosed herein to provide a self-contained chisel, which includes a striker, and thus eliminates the need for two separate tools to operate a chisel.

Third, conventional chisels are made to suit one particular purpose. Thus, a user must acquire multiple chisels that are suitable for each different purpose. For example, a carpenter's chisel has a sharpened end for cutting wood while a welding chisel may be sharpened to a wide flat blade suitable for scraping scale from a weld. The sharpened end of the carpenter's chisel would be ruined by scraping the scale off a weld. Likewise, the wide flat blade on the welding chisel is not sharp enough to cut wood. While these are merely examples of two kinds of chisels, and there are hundreds or possibly even thousands of different kinds of chisels, it is apparent that different chisels are suitable for a particular purpose. It is one object of at least one apparatus described herein to provide a chisel with removable bits that allow a user to change the bit or blade on the chisel without requiring an entirely different chisel.

SUMMARY

Consistent with embodiments disclosed herein, a self-contained force magnifying chisel is disclosed. In one implementation, a self-contained force magnifying chisel is disclosed. The self-contained force magnifying chisel includes a chisel portion, a striker, at least a portion of which is disposed within the chisel portion, and a spring, at least a portion of which is disposed within the chisel portion and which is attached to the chisel portion and the striker.

In another implementation, a self-contained force magnifying chisel is disclosed. The self-contained force magnifying chisel includes a chisel portion, a striker portion, a spring externally attached to the chisel portion and the striker portion, and a chisel bit retainer.

Also disclosed is a method of making a self-contained force magnifying chisel. The method includes disposing a spring within a chisel portion of a chisel, attaching the spring to the chisel portion, and disposing within the chisel portion, a striker.

It is to be understood that both the foregoing general description and the following detailed description are exemplary and explanatory only and do not restrict the scope of the claims.

BRIEF DESCRIPTION OF THE DRAWINGS

The accompanying drawings illustrate several embodiments of the self-contained force magnifying chisel disclosed herein and constitute a part of the specification. The illustrated embodiments exemplary and do not limit the scope of the disclosure.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1A:
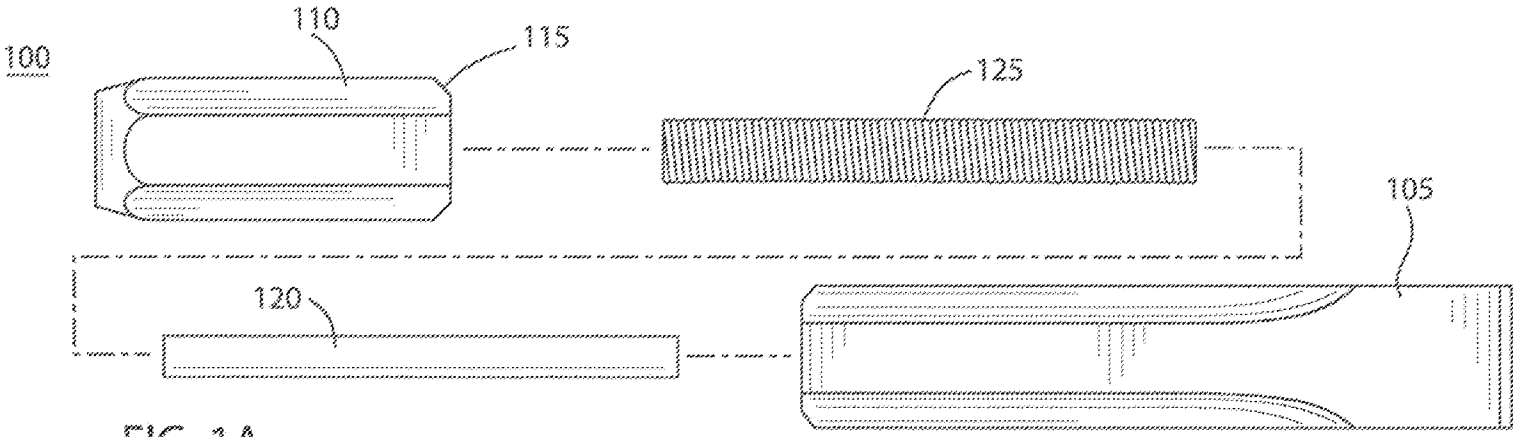
FIG. 1A illustrates an exploded view of the self-contained force magnifying chisel disclosed herein.

FIG. 1A is an exploded view of the self-contained force magnifying chisel 100 disclosed herein. Self-contained force magnifying chisel 100 includes chisel portion 105, striker portion 110, spring guide tube 120, and spring 125. As shown in FIG. 1A, spring guide tube 120 is inserted into spring 125. Spring 125 is attached on one end to chisel portion 105 of self-contained force magnifying chisel 100 and on the opposite end to striker portion 110 of self-contained force magnifying chisel 100. Thus, self-contained force magnifying chisel 100 is self-contained because it contains a both a striker and a chisel in one tool, obviating the need for two tools to operate a chisel. Further, self-contained force magnifying chisel 100 magnifies the force applied by the striker portion 110 impacting the chisel portion 105 by reducing the surface area to which the force is applied through a chisel blade on chisel portion 105. Thus, the force applied by self-contained force magnifying chisel 100 to a workpiece is magnified to exert substantially the same force applied to the relatively large surface area on chisel portion 105 struck by striker portion 110 into a smaller surface area on the workpiece by the chisel blade.

In one embodiment, chisel portion 105 and striker portion 110 may be machined from cold-rolled steel, tool steel, carbon steel, or stainless steel. However, any metal or metal alloy with hardness properties that are sufficient to be uninterrupted by multiple strikes into the same or any other similarly hard metal or metal alloy would be suitable for use in chisel portion 105 and striker portion 110. For example, metal hardness is generally identified using the Brinell Scale and a Brinell hardness number. In one embodiment, metals and metal alloys suitable for use in chisel portion 105 and striker portion 110 are rated over 500 HB on the Brinell Scale or correspondingly on other scales. Further, metals and metal alloys that are dense, i.e., have a high mass to volume ratio, such as steel, are preferred for use in striker portion 110 and chisel portion 105 over metals that are less dense, such as aluminum.

In another embodiment, chisel portion 105 includes a chisel blade. The chisel blade is machined into chisel portion 105 and shaped to provide a particular type of blade on self-contained force magnifying chisel 100. For example, the chisel blade of chisel portion 105 may be suited for mining, quarrying, sculpting, woodworking, machining, welding, machinist work, and hobbyists. Any known chisel blade or point may be implemented on chisel portion 105.

In another embodiment, spring 125 may be a coil spring made from spring steel. While in FIG. 1A, spring 125 is shown as a coil spring, this is merely representative of any type of spring that may be attached to chisel portion 105 and striker portion 110 of self-contained force magnifying chisel 100. Further, any material, metal, metal alloy, composite, or plastic with elastic properties may be used to fashion spring 125. Any spring that is able to contain sufficient mechanical energy to pull striker portion 110 into chisel portion 105 may be used as spring 125. Ideally, the mechanical energy contained within spring 125 is matched to the intended driving force of self-contained force magnifying chisel 100 and is less than the bending or breaking strength of spring 125.

In another embodiment, spring guide tube 120 may be made of any metal, metal alloy, composite, or plastic. Ideally spring guide tube 120 is in substantially frictionless contact with spring 125 such that spring 125 is free to extend and compress around spring guide tube 120. It is noted that spring guide tube 120 is shown in FIG. 1A such that spring 125 is positioned around spring guide tube 120. However, while not shown, spring 125 may also be disposed within spring guide tube 120. Spring guide tube 120 is further configured such that a length of spring guide tube 120 does not prevent striker portion 110 from impacting on chisel portion 105. In other words, the length of spring guide tube is long enough to guide spring 125 during extension of the spring but not long enough to prevent striker portion 110 from striking chisel portion 105 when mechanical energy stored by spring 125 is released.

When spring 125 is attached to both chisel portion 105 and striker portion 110, the spring is substantially fully compressed. In one embodiment, spring 125 may be configured to provide just enough compression force that spring 125 pulls chisel portion 105 and striker portion 110 together such that both chisel portion 105 and striker portion 110 butt up against each other at bevel 115.

In operation, self-contained force magnifying chisel 100 is configured to provide an operative chisel in a single tool. For example, a user may hold chisel portion 105 in one hand while the user holds striker portion 110 in another hand. The user may then apply an extension force to spring 125 such that striker portion 110 is pulled away from chisel portion 105. Mechanical energy is stored in spring 125 which is attached to both striker portion 110 and chisel portion 105 using techniques which will be described below. The mechanical energy stored in spring 125 is released when the user releases striker portion 110. The compression force of the spring pulls striker portion 110 into chisel portion 105. The force of striker portion 110 impacting chisel portion 105 applies a force to chisel portion 105 which is then applied to a workpiece. In other words, a driving force is applied to chisel portion 105, which is then magnified into a particular area on a workpiece by a chisel blade on chisel portion 105. Bevel 115 protects the chisel user's hand from pinching as striker portion 110 impacts chisel portion 105.

Figure 1B:
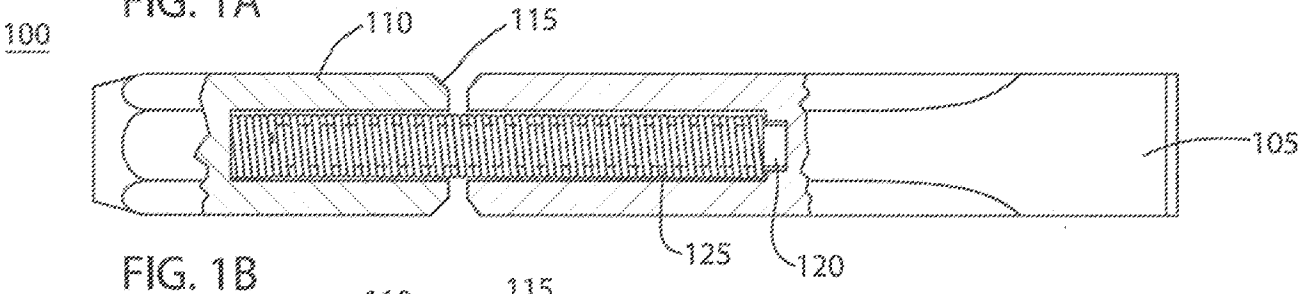
FIG. 1B illustrates a cross-sectional side view of the self-contained force magnifying chisel disclosed herein during extension.

FIG. 1B illustrates a cross-sectional side view of the self-contained force magnifying chisel 100 during extension of spring 125. As shown in FIG. 1B, chisel portion 105 and striker portion 110, to which spring 125 are attached, may be pulled apart by a user exerting an extension force on spring 125. Spring guide tube 120 is shown as disposed inside spring 125, although in some embodiments, spring 125 may be disposed inside spring guide tube 120. As striker portion 110 is separated from chisel portion 105, spring 125 extends, loading spring 125 with mechanical energy that tries to return spring 125 to a compressed state. Bevel 115 prevents the chisel portion 105 and striker portion 110 from pinching the user's fingers when striker portion 110 is released by the user.

Figure 1C:
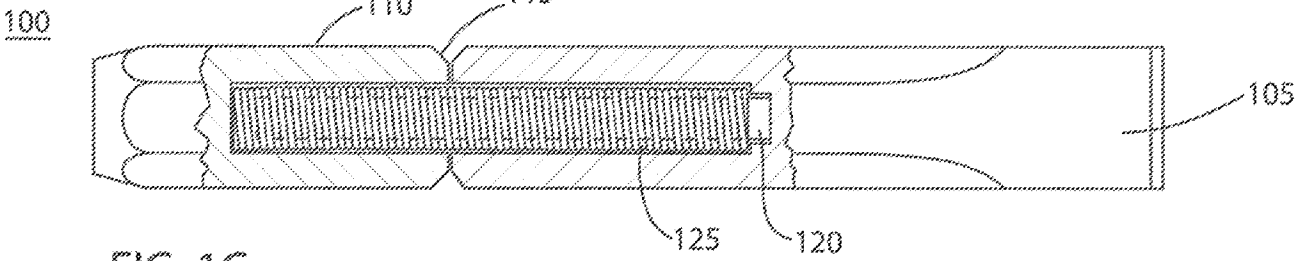
FIG. 1C illustrates a cross-sectional side view of the self-contained force magnifying chisel disclosed herein during compression.

FIG. 1C illustrates a cross-sectional side view of self-contained force magnifying chisel 100 during compression of spring 125. As discussed above, FIG. 1B shows self-contained force magnifying chisel 100 during extension of spring 125. FIG. 1C, therefore, shows self-contained force magnifying chisel 100 after the user has released the mechanical energy contained in spring 125, discussed above, by releasing striker portion 110 to impact on chisel portion 105 of self-contained force magnifying chisel 100. When striker portion 110 is released, spring guide tube 120, whether internal or external to spring 125, guides spring 125 back into a compressed state. The mechanical energy released by the spring drives striker portion 110 into chisel portion 105, creating a driving force for chisel portion 105. That force is magnified by a chisel blade on chisel portion 105 and applied to a workpiece. Bevel 115 prevents a user's hands from being pinched as striker portion 110 is released.

Figure 2A:
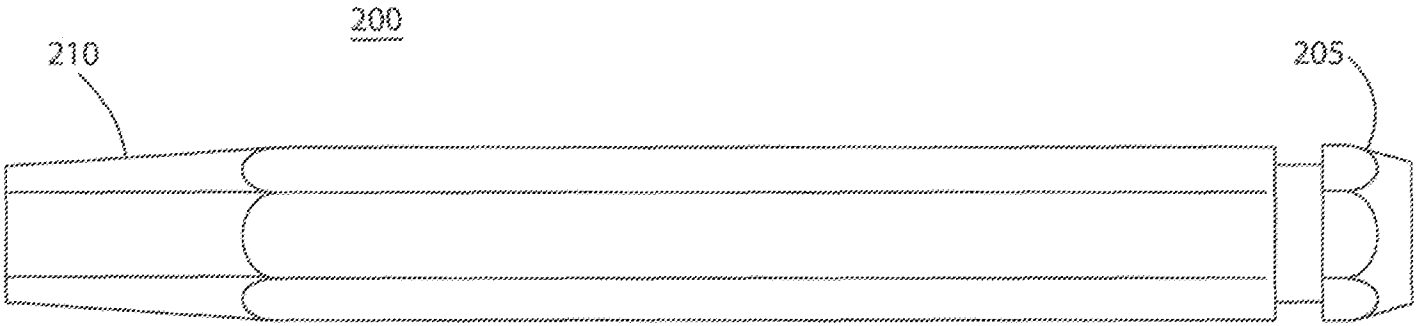
FIG. 2A illustrates a side view of the self-contained force magnifying chisel disclosed herein with an internal striker.

FIG. 2A illustrates a side view of self-contained force magnifying chisel 200 with an internal striker 205. Self-contained force magnifying chisel 200 includes a chisel portion 210 which is machined such that an inside diameter of chisel portion 210 is greater than an outside diameter of at least a portion of internal striker 205. In other words, internal striker 205, shown in FIG. 2A, includes both a male end that may be disposed inside a female end of chisel portion 210 and a handle which may be grasped by a chisel user.

Figure 2B:
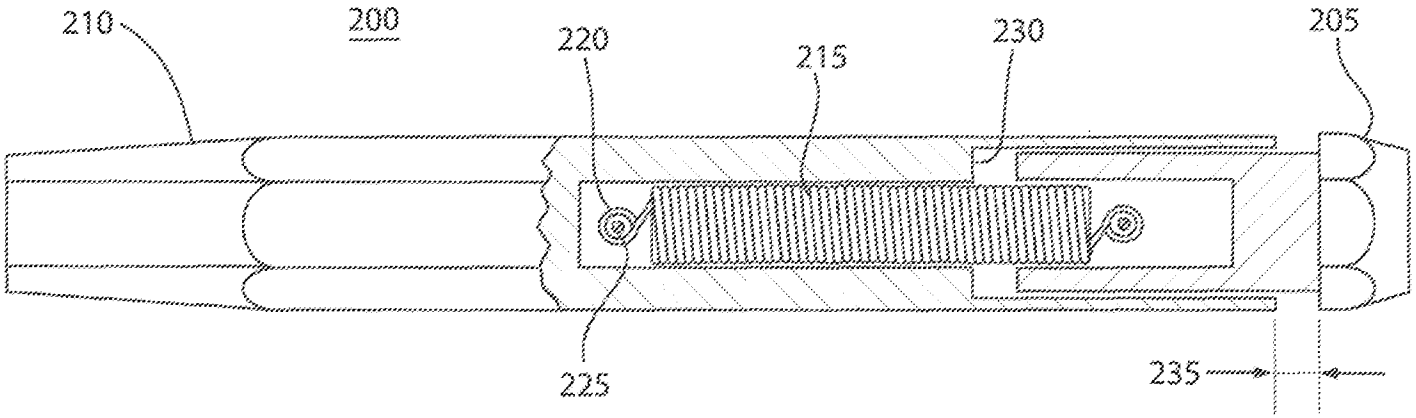
FIG. 2B illustrates a cross sectional side view of the self-contained force magnifying chisel shown in FIG. 2A.

FIG. 2B illustrates a cross sectional side view of self-contained force magnifying chisel 200 shown in FIG. 2A. As discussed above, a male end of internal striker 205 is disposed within chisel portion 210 and includes a handle that may be grasped by a user. Also disposed within chisel portion 210 of self-contained force magnifying chisel 200 is spring 215, which is attached to both chisel portion 210 and internal striker 205. FIG. 2B does not show a spring guide tube. However, a spring guide tube, such as spring guide tube 120 discussed with respect to FIG. 1A may be included in some embodiments. Rather, in FIG. 2B, chisel portion 210 has been machined such that spring 215 may be disposed within chisel portion 210. Thus, the internal portion of chisel portion 210 may act as a spring guide tube, guiding spring 215 as it is extended and compressed. Spring 215 may be configured such that one or more spring coils 220 on each end of spring 215 are bent to be substantially perpendicular to the rest of spring 215. The term substantially perpendicular means that one or more spring coils 220 are bent such that a spring retainer 225 may be disposed in chisel portion 210 and through one or more spring coils 220 of spring 215. Spring 215 may therefore be attached to chisel portion 210 by spring retainer 225.

Spring retainer 225 may include a pin, a tapered pin, a screw, a bolt, a rivet, a rod, or any other similar device. In one embodiment, a pin, acting as spring retainer 225 may be inserted through a hole, corresponding in size to the pin, in chisel portion 210 through one or more spring coils 220, and into another hole in chisel portion 210. Thus, the pin is supported on two sides by holes in chisel portion 210 and travels through one or more spring coils 220 in order to attach spring 215 to chisel portion 210.

A second spring retainer 225 may be installed in internal striker 205 to attach spring 215 to internal striker 205 in the same manner that spring retainer 225 is installed on chisel portion 210. For example, spring 215 may have one or more spring coils 220 bent such that one or more spring coils 220 are substantially perpendicular to spring 215. The term substantially perpendicular means that one or more spring coils 220 are bent such that spring retainer 225 may be disposed in internal striker 205 and through one or more spring coils 220 of spring 215. Spring 215 may also be disposed within internal striker 205. Further, a second spring retainer 225 may be inserted through holes in internal striker 205 and through one or more spring coils 220. Thus, spring 215 is attached to both chisel portion 210 and internal striker 205.

Once spring 215 is attached to both chisel portion 210 and internal striker 205, spring 215 pulls chisel portion 210 and internal striker 205 together. In order to create an impact point between internal striker 205 and chisel portion 210, chisel portion 210 further includes impact shoulders 230. Impact shoulders 230 receive blows from internal striker 205 when spring 215 is extended and released. Thus, as shown in FIG. 2B, the inside of chisel portion 210 is configured such that spring 215 may be disposed within chisel portion 210 and, in some embodiments, act as a guide for spring 215, while also providing impact shoulders 230 that are struck by internal striker 205. FIG. 2B shows spring 215 in a slightly extended state. When spring 215 is in a compressed state, internal striker 205 rests on impact shoulders 230 within chisel portion 210.

In operation, a user pulls on internal striker 205 with one hand while holding chisel portion 210 in another hand, extending spring 215. The extension of spring 215, which is retained by a spring retainer 225 in both chisel portion 210 and internal striker 205, creates mechanical energy in spring 215. When the user releases internal striker 205, the mechanical energy in spring 215 is released, driving internal striker 205 into impact shoulders 230 of chisel portion 210. The driving force created when internal striker 205 impacts shoulders 230 of chisel portion 210 is magnified by a chisel blade on chisel portion 210 of self-contained force magnifying chisel 200. In order to prevent pinching of the user's hands, gap 235 is created between the handle of internal striker 205 and chisel portion 210. The length of the male end of internal striker 205 may be adjusted such that the handle of internal striker 205 does not impact chisel portion 210. Rather, the impact of the internal striker 205 is applied only to chisel portion 210 through impact shoulders 230. The length of the male end of internal striker 205 is configured to prevent internal striker 205 from being removed from the female end of chisel portion 210 during extension of spring 215.

Figure 3A:
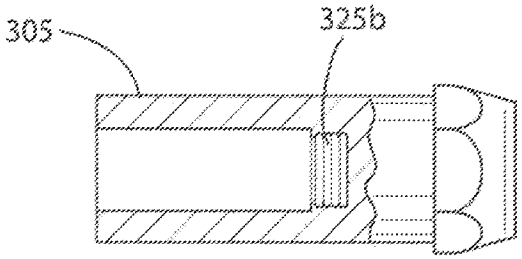
FIG. 3A illustrates a cross sectional side view of an internal striker of the self-contained force magnifying chisel disclosed herein.

FIG. 3A illustrates a cross sectional side view of internal striker 305 of self-contained force magnifying chisel 300, which will be discussed below. In FIG. 3A, internal striker 305 contains spring retainer 325*b* inside internal striker 305. Spring retainer 325*b* is configured to allow a spring, such as spring 320, which will be discussed below, to thread into internal striker 305.

Figure 3B:
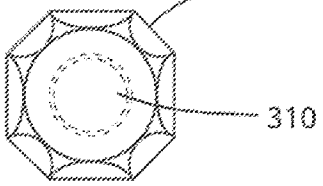
FIG. 3B illustrates a rear view of an internal striker of the self-contained force magnifying chisel disclosed herein.

FIG. 3B illustrates a rear view of internal striker 305 of self-contained force magnifying chisel 300, which will be described below. Internal striker 305 may be beveled on the handle end, as shown in FIG. 3B in order to give the user a better grip on internal striker 305. Both the beveling in the handle and chisel portion 315, which will be discussed below, may be tooled, texturized, checkered, hammered, or subjected to any other technique that improves grip. Surface 310 of internal striker 305 may be rounded or flat.

Figure 3C:
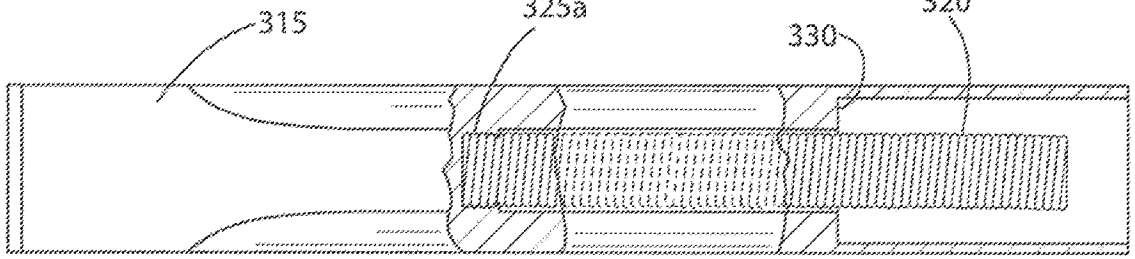
FIG. 3C illustrates a cross sectional side view of a chisel portion of the self-contained force magnifying chisel disclosed herein.

FIG. 3C illustrates a cross sectional side view of chisel portion 315 of self-contained force magnifying chisel 300. Spring 320 is disposed inside chisel portion 315 as discussed above with respect to FIG. 2B. However, in FIG. 3C, spring 320 is attached to chisel portion 315 of self-contained force magnifying chisel 300 with spring retainer 325*a*. In this embodiment, spring retainer 325*a* comprises threads. The size and pitch of the threads in spring retainer 325*a* are set such that the coils of spring 320 may thread into the threads in spring retainer 325*a*, much like a bolt threads into a nut. Once spring 320 is threaded into the threads in spring retainer 325*a*, spring 320 is retained in chisel portion 315. Impact shoulders 330 shown in FIG. 3C are similar to impact shoulders 230 in FIG. 2B and are used in the same way.

Figure 3D:
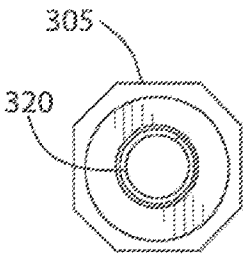
FIG. 3D illustrates front view of an internal striker of the self-contained force magnifying chisel disclosed herein.

FIG. 3D illustrates front view of internal striker 305 of self-contained force magnifying chisel 300. As shown in FIG. 3D, spring 320 has been threaded into threads in spring retainer 325*b*, shown in FIG. 3A, and is retained inside internal striker 305.

Figure 3E:
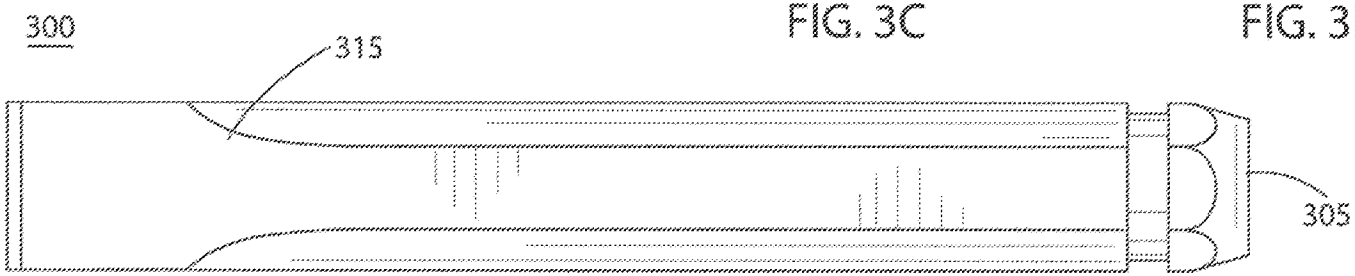
FIG. 3E illustrates a side view of the self-contained force magnifying chisel in which the internal striker and the chisel portion are assembled according to one embodiment of the self-contained force magnifying chisel.

FIG. 3E illustrates a side view of the self-contained force magnifying chisel 300 in which internal striker 305 and the chisel portion 315 are assembled according to one embodiment of self-contained force magnifying chisel 300. In FIG. 3E, spring 320 has been installed into threads of spring retainer 325*a* in chisel portion 315 and spring retainer 325*b* within internal striker 305 as shown in FIGS. 3A and 3C. Because spring 320 of FIG. 3C is retained by spring retainers 325*a* and 325*b* of FIGS. 3A and 3C within chisel portion 315 and internal striker 305, respectively, an extension force can be applied to spring 320 by a user. As a user pulls on internal striker 305 with one hand and holds chisel portion 315 with another hand, spring 320 is extended and stores mechanical energy. When internal striker 305 is released by the user, spring 320 returns to a compressed state, transferring the mechanical energy stored in spring 320 into a driving force when internal striker 305 impacts impact shoulders 330 within chisel portion 315. The driving force is magnified by a chisel blade on chisel portion 315 and applied to a workpiece.

Figure 4A:
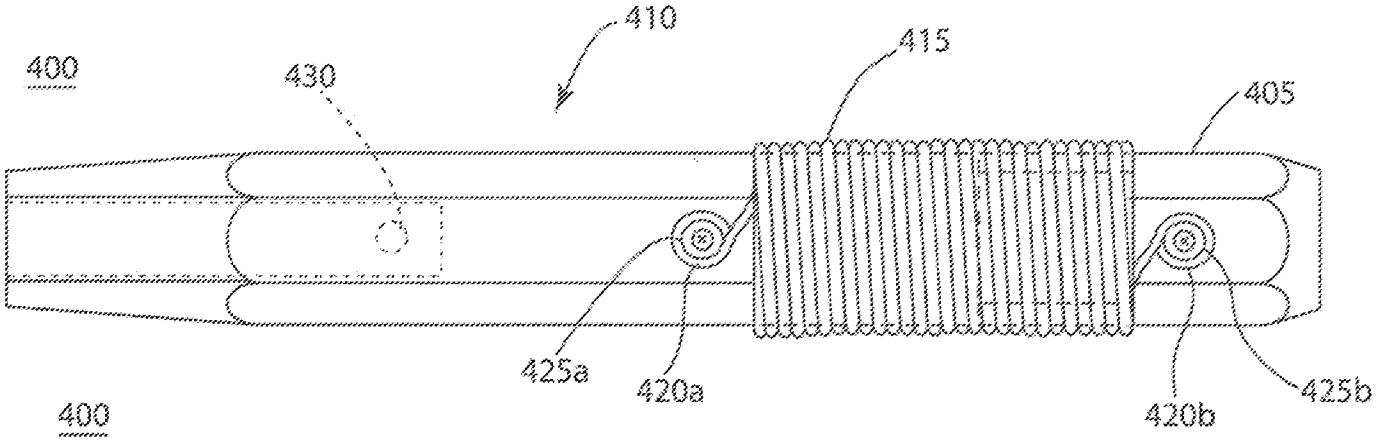
FIG. 4A illustrates another exemplary implementation of the self-contained force magnifying chisel.

FIG. 4A illustrates an exemplary implementation of self-contained force magnifying chisel 400. Self-contained force magnifying chisel 400 includes a striker portion 405 and a chisel portion 410. Spring 415 is attached to chisel portion 410 by one or more spring coils 420*a* affixed to chisel portion 410 by spring retainer 425*a*. Similarly, spring 415 is attached to striker portion 405 by one or more spring coils 420*b* affixed to striker portion 405 by spring retainer 425*b*. In this embodiment, spring 415 is external to striker portion 405 and chisel portion 410.

Spring retainer 425*a*, as shown in FIG. 4A, is a screw which attaches one or more spring coils 420*a* to chisel portion 410. Spring retainer 425*b*, as shown in FIG. 4A, is also a screw which attaches one or more spring coils 420*b* to striker portion 405. However, as discussed above with respect to FIG. 2C, spring retainers 425*a* and 425*b* are not limited to screws. Spring retainers 425*a* and 425*b* may include a pin, a tapered pin, a screw, a bolt, a rivet, a rod, or any other similar device that attaches spring 415 to chisel portion 410 and striker portion 405.

In implementation, a user pulls on striker portion 405 with one hand while holding chisel portion 410 with another hand, extending spring 415. When spring 415 is extended, mechanical energy is stored in spring 415. When striker portion 405 is released by the user, spring 415 returns to a compressed state, transferring the mechanical energy stored in spring 415 into a driving force as striker portion 405 impacts chisel portion 410. The driving force is magnified by the blade of chisel portion 410 and applied to a workpiece.

FIG. 4A further includes a bit retainer 430. In this embodiment, which is yet another example of implementations that are not specific to a particular figure, chisel portion 410 is configured to receive various chisel bits, removably held in place by bit retainer 430. Bit retainer 430 is shown as a detent ball recess in FIG. 4A. However, other bit retainers may be used. Exemplary bit retainers include a c-clip, through-wedged tenon joints, pins, tapered pins, threaded pins, set screws, magnets, screws, bolts, detent balls, and any other known bit retention means. Thus, while a detent ball recess is shown to represent bit retainer 430 in FIG. 4A, the disclosure is not limited to a detent ball recess for the bit retainer 430.

Figure 4C:
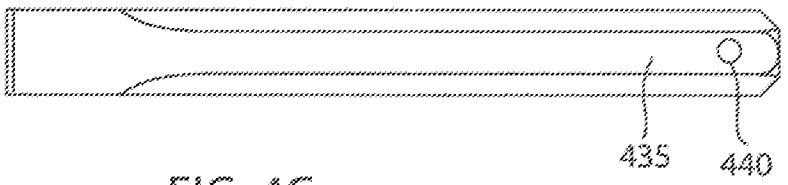
FIG. 4C illustrates a side view of a removable chisel bit.
Figure 4B:
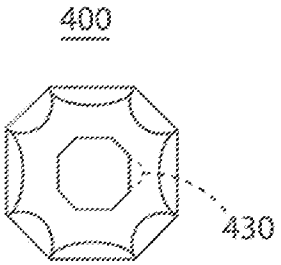
FIG. 4B illustrates a front view of the self-contained force magnifying chisel disclosed herein.

FIG. 4B illustrates a front view of self-contained force magnifying chisel 400 which includes a bit retainer 430, shown as a detent ball recess for purposes of explanation. However, as discussed above, bit retainer 430 is not limited to the use of a detent ball and corresponding detent ball recess.

FIG. 4C illustrates a side view of a removable chisel bit 435 which can be inserted into chisel portion 410. As discussed above, particular chisels serve a particular purpose and are generally useful only for that particular purpose. Thus, by providing removable bits, the utility of self-contained force magnifying chisel 400 is enhanced such that one self-contained force magnifying chisel 400 is usable for multiple different applications. For example, self-contained force magnifying chisel 400 can use a bull point bit for chiseling concrete and then change to a flat chisel bit for cleaving masonry bricks. Removable chisel bit 435 includes a bit retainer 440 corresponding to bit retainer 430 shown in FIGS. 4A and 4B. While bit retainer 440 is represented in FIG. 4C as a detent ball, other implementations are possible. For example, if a c-clip is used as bit retainer 430, bit retainer 440 in removable chisel bit 435 may include a slot cut around the removable chisel bit, into which the c-clip fits. In another example, bit retainers 430 and 440 may be holes through which a pin may be installed that holds removable chisel bit 435 into chisel portion 410 of self-contained force magnifying chisel 400. Thus, a single chisel may be used for a plurality of applications by exchanging one bit for another.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A chisel comprising:

a chisel portion including impact shoulders disposed within the chisel portion, a striker, at least a portion of which is disposed within the chisel portion, and a spring, at least a portion of which is disposed within the chisel portion and at least a portion of which is disposed within the striker, and which is attached to the chisel portion and the striker, wherein the striker, disposed within the chisel portion, impacts the chisel portion on the impact shoulders disposed within the chisel portion.

2. The chisel of claim 1, wherein said spring is disposed inside a spring guide tube.

3. The chisel of claim 1, wherein the spring is attached to the chisel portion by a spring retainer.

4. The chisel of claim 3, wherein the spring retainer is inserted through one or more spring coils of the spring.

5. The chisel of claim 3, wherein the spring retainer comprises threads.

6. The chisel of claim 1, wherein a gap is provided between a handle portion of the striker and the chisel portion when the spring is in a compressed state.

7. A method of making a chisel, comprising:

disposing a spring within a chisel portion of a chisel, the chisel portion of the chisel including impact shoulders disposed within the chisel portion of the chisel;

attaching the spring to the chisel portion of the chisel portion within the chisel, and disposing, within the chisel portion of the chisel, a striker, the spring being disposed within the striker and attaching to the striker within the striker, the striker being disposed in the chisel portion of the chisel to impact the chisel portion on the impact shoulders disposed within the chisel portion.

8. The method of claim 7, further comprising providing a spring retainer for attaching the spring to the chisel portion.

9. The method of claim 8, further comprising providing the spring retainer with threads.

10. The method of claim 8, further comprising providing the spring with one or more spring coils through which the spring retainer is inserted.

* * * * *